United States Patent [19]

Kazmierski

[11] Patent Number: 4,681,992

[45] Date of Patent: Jul. 21, 1987

[54] CUSHIONED CLAMP CYLINDER WITH PROXIMITY SWITCHES

[75] Inventor: Ronald J. Kazmierski, Mt. Clemens, Mich.

[73] Assignee: C. M. Smillie & Company, Ferndale, Mich.

[21] Appl. No.: 836,738

[22] Filed: Mar. 6, 1986

[51] Int. Cl.[4] ..... H01H 35/38

[52] U.S. Cl. ..... 200/82 E; 200/82 R; 200/34; 200/82 A

[58] Field of Search ..... 200/82 E, 82 A, 82 R, 200/34

[56] References Cited

U.S. PATENT DOCUMENTS

| | | | |
|---|---|---|---|
| 816,348 | 3/1906 | Miller | 200/82 A |
| 1,679,212 | 7/1928 | Forman | 200/82 A |
| 3,374,320 | 3/1968 | Buhler et al. | 200/34 |

*Primary Examiner*—Robert S. Macon

*Attorney, Agent, or Firm*—Cullen, Sloman, Cantor, Grauer, Scott & Rutherford

[57] ABSTRACT

A cushioned clamp cylinder with proximity switches includes a cap of square shape defining a plurality of right angularly related end faces with a cushion chamber in the cap and a sensing port in each end face communicating with the cushion chamber. A normally open proximity switch is selectively positioned in one of the sensing ports adjacent the chamber; one sensing port is connected to a pressure conduit and the other two sensing ports are plugged. A piston rod mounting a piston is positioned within the cylinder and mounts an inductive sleeve movable into the cushion chamber to activate the proximity switch. A flexible annular insert ring is positioned within the cap and has a wiping bead which extends into the cushion chamber and seals over the sleeve sealing the cushion chamber providing a pressure build-up and bringing the piston to a smooth stop as it bottoms out within the cylinder. A bleed screw is adjustably threaded into the cap and communicates with the cushion chamber.

6 Claims, 2 Drawing Figures

FIG.1
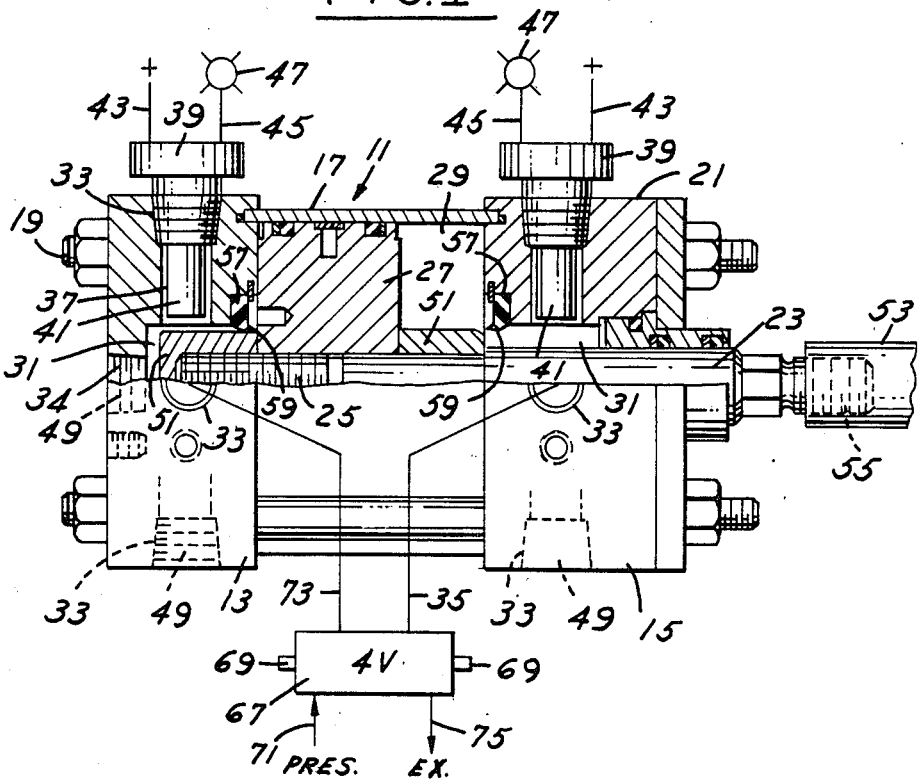
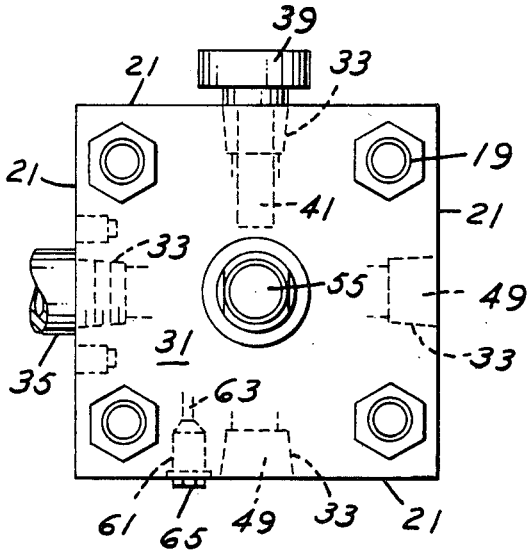
FIG.2

CUSHIONED CLAMP CYLINDER WITH PROXIMITY SWITCHES

The present invention relates to a cushioned clamp cylinder including proximity switches upon its cap and head and with air cushion chambers within the cap and head for alternately bringing the reciprocal loaded piston and piston rod to a smooth stop with the proximity switches alternately providing a visible indication of the bottoming out of a piston at opposite ends of the cylinder.

BACKGROUND OF THE INVENTION

Both pneumatic and hydraulic cylinders are manufactured with or without cushions to eliminate destructive hard stops and pounding caused by the tool or the cylinder bottoming out against the cylinder head or cap while traveling at full velocity. Heretofore proximity switches have been employed to provide a visible or other control indication of the otherwise non-visible bottoming out of the corresponding piston at opposite ends of the cylinder.

The cylinders, particularly the pneumatic, without cushions may bang at either end of their stroke. To prevent this banging, the cushion may be installed internally at either or both ends of the cylinder. To visibly indicate when a piston bottoms out within a cylinder at either end of its stroke probes are installed within the corresponding cap and head which senses when the piston "bottoms out" and provides an electrical signal which may be used to light an indicator lamp or to move a valve.

Since the moving piston assembly possesses high kinetic energy because of high mass or velocity, it will bang on bottoming out. Heretofore, adjustable cushions could not be used on clamp cylinders with proximity switches because with ports in all faces of the cap and head there was no room to install a cushion adjusting bleed screw and ball check.

SUMMARY OF THE INVENTION

An important feature of the present invention is to provide a pneumatic or hydraulic cylinder with cushioned chambers and incorporating proximity switches at opposite ends of the cylinder for a visible indication of bottoming out of the reciprocal piston at opposite ends of said cylinder.

Another feature is to employ cushions at one or both ends of the cylinder which already carries proximity switches in order to prevent hammering of the piston upon one or both ends of the cylinder.

As another feature and to make the cushion cylinder universal in its application, there are employed square head clamp cylinders, each cap and head having a series of right angularly related end faces and with each face ported on four sides of the head and on all four sides of and the rear face of the cap.

An important feature is to provide a cushioned construction employing a flexible insert to eliminate the need for a ball check valve as heretofore employed for cushioning cylinders and wherein the flexible insert seal mounted upon the interior of the cap and head seals against corresponding portions of the piston rod so as to perform the function heretofore employed by the ball check valve, namely the entrapping of the pressurized air within the cushion chamber as the respective piston rod moves towards bottoming out position.

Another feature includes selective application of a cushion adjustment bleed screw for each cushion chamber, adjustably threaded into one of the ported faces of the cap and head laterally offset relative to the adjacent port centerline.

Another important feature of employing a cushion proximity switch clamp cylinder is to eliminate destructive hard stops caused by the tool or the cylinder piston bottoming out against the cylinder head or cap while traveling at high velocity, for extending the tool life, and reducing weld breakage.

As a further feature the adjustable cushion allows tool speed at either ends of the cylinder stroke to be reduced to non-destructive levels thus extending tool life.

These and other features and objects will be seen from the following specification and claims in conjunction with the appended drawing.

THE DRAWING

FIG. 1 is a partly sectioned side elevation of the present cushioned air cylinder with proximity switches and with the pneumatic connections schematically shown.

FIG. 2 is a right and elevational view thereof.

It will be understood that the above drawing illustrates merely a preferred embodiment of the invention, and that other embodiments are contemplated within the scope of the claims hereafter set forth.

DETAILED DESCRIPTION OF AN EMBODIMENT OF THE INVENTION

Referring to the drawings, an air cylinder assembly 11 is shown in FIG. 1, sometimes referred to as a cushioned clamp cylinder. The cylinder assembly includes the cap 13 and spaced therefrom the head 15, both square in cross section, arranged at opposite ends of cylinder 17. The cap and head are secured and assembled and are sealed over the cylinder ends by a plurality of elongated assembly bolts 19 which extend between the respective cap and head.

The respective cap 13 and head 15 being square, there are defined for said cap and head a series of right angularly related end faces 21. The cylinder assembly further includes piston rod 23 threaded at one end at 25 over which is threaded and mounted the piston 27 movably positioned and sealed in a conventional manner within chamber 29 cylinder sleeve 17.

Opposed cushion chambers 31 are axially formed within the respective cap 13 and cylinder head 15 in communication with the plurality of right angularly related sensing ports 33 formed in each of the faces 21 of said cap and head.

Pressure supply conduit 35 is adapted for selective connection to one of the sensing ports 33 in head 15. Pressure conduit 73 is adapted for selective connection to one of the sensing ports 33 of cap 13, FIG. 1. Each of the sensor ports 33 terminate in a cylindrical sensor chamber 37 which communicates with the respective cushion chamber 31.

A proximity switch 39, sometimes referred to as a normally open proximity switch, includes an elongated probe 41 which is selectively positioned within one of the sensing ports 33 and a corresponding sensor chamber 37, FIG. 1, whose inner end is adjacent cushion chamber 31.

In the illustrative embodiment, there is schematically shown at 43 a suitable electrical power lead to proximity switch 39 which is normally open and which includes an output lead 45, in the illustrative embodiment connected to a light bulb 47 which will be energized when the proximity switch is closed.

For illustrative purposes, the proximity switch 39, FIG. 1 is positioned 90° out of its normal position with respect to cap 13. It is contemplated that the proximity switch 39 and its corresponding probe 41 may be projected into any of the sensing ports of cap 13 and head 15 as desired.

Upon one end of piston rod 23 there is threaded as at 25 an inductive sleeve 51, preferably constructed of steel, which is adapted to move into cushion chamber 31 at the end of the stroke of piston 27 in one direction. Such movement of the inductive sleeve 51 to the position shown in FIG. 1 inductively closes the normally open proximity switch 39 and energizes the light bulb 47 indicating that piston 27 has bottomed out at one end of cylinder 17. This provides a visible indication of such bottoming out, not otherwise available without the proximity switch. The bottoming out position also corresponds to the maximum force which is exerted by a clamp arm upon a workpiece wherein the clamp arm is operably connected to the threaded end 55 of the piston rod 23 over which is mounted a rod end 53 schematically shown.

As shown in FIG. 1, there is a second inductive sleeve 51 mounted and secured upon piston rod 23 upon the opposite side of piston 27. In the position of the piston shown in FIG. 1, the right hand inductive sleeve 51 is positioned outwardly of the adjacent cushion chamber 31 formed within head 15.

Nested within each of the said cap and head is a flexible insert ring 57 constructed or rubber of Neoprene TM which is anchored and retained within a corresponding axial slot within the respective cap and head adjacent opposite ends of cylinder 17.

The flexible insert ring 57, being annular in form, includes an internal annular wiper flange 59 which projects into the respective cushion chamber 31 and is adapted for alternate snug sealing engagement with the corresponding inductive sleeves 51 upon said piston rod.

As shown in FIG. 2, there is provided within one of the end faces 21 of each of the cap 13 and head 15, a threaded port 61 which is laterally offset with respect to the adjacent sensing port 33. The inner end of offset port 61 communicates with a bleed passage 63 in communication with the adjacent cushion chamber 31.

The cushion adjustable bleed screw 65, which is axially apertured, is ajustably positioned within port 61 to provide for the regulated exhaust of compressed air from the corresponding cushion chamber 31. While a single port 61 is illustrated in FIG. 2, adjacent and spaced laterally of the sensing port 33, it is contemplated that there may be within each of the end faces 21 of each of the cap and head corresponding offset ports 61, normally plugged up when not in use, for the selective aplication of a cushion adjustment bleed screw 65.

Schematically shown in FIG. 1 is a conventional four way valve 67 connected to a source of pressurized fluid as at 71, such as compressed air, wherein in the illustrative embodiment solenoids 69 are applied to opposite ends of the four way valve for effecting reciprocal movements of the internal control valve element by which pressurized fluid is selectively delivered to opposite ends of cylinder 17 and to the corresponding cap 13 and head 15 by conduits 35 and 73.

At any particular time, one conduit delivers pressure and the other conduit exhausts pressure fluid back to the four way valve exhausting as at 75. This is a conventional operation and is shown only for a complete illustration of the functioning of the present cushion cylinder for effecting alternate reciprocal movements of piston 27 within cylinder 17 and wherein the corresponding inductive sleeves 31 alternately move into the corresponding cushion chambers 31 for activating and closing the adjacent proximity switch 39.

In operation, at the moment that the piston 27 bottoms out with respect to cap 13, corresponding inductive sleeve 51 is in the position shown within cushion chamber 31 and adjacent probe 41 of proximity switch 39 for closing the normally open switch. This supplies electrical power through lead 45 to bulb 47 to visibly indicate bottoming out of the piston 27 relative to cap 13.

When the piston 27 has moved to the opposite end of cylinder 17 and into the corresponding cushion chamber 31 within head 15, the corresponding adjacent inductive sleeve 51 is so positioned adjacent the inner end of probe 41 of the proximity switch 39 as to close such switch and energize a second bulb 47 through lead 45. Each of the proximity switches is powered by the leads 43 from a suitable electrical power source.

Heretofore in conventional cylinders incorporating proximity switches at their opposite ends, there was required the use of a one way ball check valve in conjunction with an adjustable bleed screw. Heretofore, adjustable cushions could not be used on clamp cylinders with proximity switches because with ports in all faces there was no room for installing the cushion adjusting screw and ball check.

In the present construction, the ball check valve has been eliminated. The flexible inserts 57 within the respective cap and head perform the additional function heretofore performed by the ball check valve, namely of trapping compressed air within the corresponding cushion chamber 31 as the respective piston end or inductive sleeve moves into such chamber.

The corresponding internal sealing bead 59 snugly and yieldably engages the adjacent inductive sleeve 51 as said sleeve moves into the cushion chamber 31. This prevents escape of pressurized air within the cushion chamber and wherein said flexible insert 57 functions as a ball check valve and the build-up of pressurized air within the cushion chamber brings the adjacent end portion of piston rod 23 and inductive sleeve 51 to a gradual stop as the piston 27 bottoms within cylinder 17 adjacent cap 13, for illustration.

The increasing pressure of air, for illustration, upon the interior of chamber 31 is applied to the annular bead portion 59 of the annular insert 57 increasing the seal of the flexible insert upon and with respect to sleeve 51, FIG. 1. The same function occurs when the second inductive sleeve 51 begins to move into the adjacent cushion chamber 31 in head 15.

In the present construction and to provide a universal application for the cylinder assembly 17, the respective square cap 13 and head 15 provide a means of providing sensing ports 33 in each of the right angularly related faces thereof. This permits selective application thereto of a proximity switch 39 at opposite ends of the cylinder assembly at one sensing port, for the selective application for one of the pressure and exhaust conduits 35, 73 into a second of the ports 33 and with remaining ports plugged.

As an alternate construction there is provided within the end face of cap 13 an axial bore 34 which is plugged at 49, FIG. 1. As an alternative location, the adjacent proximity switch 39 and its corresponding probe 41 may be projected into axial bore 49 utilizing a suitable spacer for communication with cushion chamber 31. In that case, the corresponding radial sensing port 33 is plugged.

The proximity switches 39 are particularly useful to provide a visible indication of the bottoming out of the piston 27 with respect to the adjacent cap 13 or head 15. Normally the bottoming out of said piston corresponds to the maximum forces transmitted by the piston rod to a load such as a clamp arm, for illustration. This provides a means for manually adjusting the bleed screw 65 to control exhausting of compressed fluids, such as compressed air, from the adjacent chamber 31 during the entry of the piston rod and adjacent sleeve 51 into such chamber such as will bring the piston and piston rod to a smooth stop at the point of bottoming out of the piston. This provides a means of so setting up the workpiece support relative to the clamp employed under the control of the present cushion cylinder such will accommodate variable clamping forces which may be reactively applied to the piston rod and piston 27 as it moves to a bottomed out position.

Since the forces vary, the bleed screw 65 must be adjusted to provide such sufficient bleeding of compressed air from the adjacent cushion chamber 31 so that the piston and piston rod come to a smooth stop at the end of the stroke corresponding to the bottoming out of the piston as designated by the light 47 under the control of the adjacent proximity switch. Thus the present cushion assembly functions in conjunction with the visible indication of piston bottoming out with respect to opposite ends of the cushion cylinder.

Having described my invention, reference should now be had to the following claims:

I claim:

1. A cushioned clamp cylinder with proximity switches comprising a cylinder assembly including a cylinder having a spaced cap and head of square shape defining a plurality of right angularly related end faces, there being sealed opposed cushion chambers in said cap and head, there being a sensing port in each end face of said cap and head communicating with said cushion chamber;

a normally open proximity switch connected to a light and having an inductive probe selectively positioned into one of said sensing ports adjacent each cushioned chamber;

one sensing port of said cap and head being connected to a pressure conduit and the other two sensing ports being plugged;

said cylinder assembly including a piston rod mounting a reciprocal piston within said cylinder;

spaced inductive sleeves mounted on said piston rod alternately movable into said cushion chambers, for alternately activating the proximity switches as said piston bottoms at opposite ends of said cylinder;

a flexible annular insert ring axially positioned and retained within said cap and head respectively, having an internal annular wiping bead in sealing engagement with and centrally receiving said inductive sleeves for alternately sealing off said cushion chambers, the compressed air in said chambers bringing said piston to a smooth stop as it bottoms out within said cylinder;

and an apertured bleed screw adjustably threaded into each cap and head laterally offset from an adjacent sensing port and in communication with said cushion chambers respectively, for regulating exhaust bleeding therefrom depending upon the load reactively applied to said piston, said proximity switches on alternately closing providing a visible indication of the respective bottoming out of said piston at opposite ends of said cylinder.

2. A cushioned clamp cylinder with proximity switches comprising a cylinder assembly including a cylinder having a cap of square shape defining a plurality of right angularly related end faces, there being a sealed cushion chamber in said cap, there being a sensing port in each end face of said cap communicating with said cushion chamber;

a normally open proximity switch connected to a light and having an inductive probe selectively positioned into one of said sensing ports adjacent said cushion chamber;

one sensing port of said cap being selectively connected to a pressure conduit and the other two sensing ports being plugged;

said cylinder assembly including a piston rod mounting a reciprocal piston within said cylinder;

an inductive sleeve mounted on said piston rod intermittently movable into said cushion chamber for activating the proximity switch as said piston bottoms at one end of said cylinder;

a flexible annular insert ring axially positioned and retained with said cap, having an internal annular wiping bead in sealing engagement with and centrally receiving said inductive sleeve for intermittently sealing off the compressed air in said chamber, the compressed air in said cushion chamber acting on said piston rod bringing said piston to a smooth stop as it bottoms out within said cylinder;

and an apertured bleed screw adjustably threaded selectively into said cap laterally offset from an adjacent sensing port and in communication with said cushion chamber for regulating exhaust air bleeding therefrom depending upon the load reactively applied to said piston, said proximity switch on intermittent closing providing a visible indication of the bottoming out of said piston at one end of said cylinder.

3. In the cushioned clamp cylinder of claim 2, said insert ring being nested and retained within an internal annular slot within said cap adjacent one end of said cylinder, said wiping bead extending into said cushion chamber, pressure build-up within said cushion chamber biasing said bead against said inductive sleeve throughout 360°.

4. In the cushioned clamp cylinder of claim 2, there being a normally plugged axial sensing port in the end of said cap communicating with said cushion chamber, said proximity switch being selectively positioned within said axial sensing port, the remaining sensing port being plugged.

5. In the cushioned clamp cylinder of claim 1, said inductive sleeves being arranged upon opposite sides of said piston, adapted for alternate projection into said cushion chambers in sealing engagement with said insert rings respectively.

6. In the cushioned clamp cylinder of claim 2, said piston on movement towards said cushion chamber compressing air therein, said insert ring on engagement with said sleeve trapping said air within said cushion chamber, functioning like a ball check valve as movement of the piston and sleeve towards bottoming out position progressively increases the air compression in said cushion chamber.

* * * * *